United States Patent [19]

Everett, Jr.

[11] Patent Number: 4,600,319

[45] Date of Patent: Jul. 15, 1986

[54] CONTROL FOR DOT MATRIX PRINTERS OPERATING IN HARSH ENVIRONMENTS

[75] Inventor: Seth L. Everett, Jr., Lincroft, N.J.

[73] Assignee: The United States of America as represented by the Secretary of the Army, Washington, D.C.

[21] Appl. No.: 741,940

[22] Filed: Jun. 6, 1985

[51] Int. Cl.[4] ..... B41J 29/38

[52] U.S. Cl. ..... 400/54; 400/52; 400/668; 400/679

[58] Field of Search ..... 400/50, 51, 52, 54, 400/679, 279, 366, 322, 425, 323, 668; 178/17.5; 307/120, 121

[56] References Cited

U.S. PATENT DOCUMENTS

| | | | |
|---|---|---|---|
| 3,354,372 | 11/1967 | Beasley | 400/54 X |
| 3,718,243 | 2/1973 | Chvatlinsky | 400/52 |
| 3,753,004 | 8/1973 | Dominic | 400/54 X |
| 3,924,722 | 12/1975 | Wienhold | 400/52 X |
| 3,973,662 | 8/1976 | Fulton | 400/50 X |
| 4,203,678 | 5/1980 | Nordstrom et al. | 400/322 X |
| 4,405,245 | 9/1983 | Fukushima | 400/322 X |

FOREIGN PATENT DOCUMENTS

| | | | |
|---|---|---|---|
| 126474 | 9/1980 | Japan | 400/50 |

*Primary Examiner*—Paul T. Sewell

*Attorney, Agent, or Firm*—Anthony T. Lane; Jeremiah G. Murray; Paul A. Fattibene

[57] ABSTRACT

A control processing method and apparatus for dot matrix printers which are subjected to relatively high levels of vibration and shock. Vibration and shock are detected and, in the event that a known safe vibration or shock level is exceeded, print line data being fed alternately to the print head from a pair of data print buffers coupled to the output of a logic data input buffer are inhibited while the input buffer temporarily stores the incoming data. Drive pulses applied to the stepper motor used to move the print head carriage are simultaneously stopped. When the detected level falls below a set threshold indicative of a safe operating level, normal operation is resumed with the print data again being fed from the input buffer to the print line buffers which are reactivated along with the carriage stepper motor. Additionally, any positional change of the print head carriage during the existence of shock or vibration levels above the threshold value from the last valid driven position is determined and accordingly repositioned prior to continuing the printing operation upon cessation of the disturbance.

22 Claims, 7 Drawing Figures

CONTROL FOR DOT MATRIX PRINTERS OPERATING IN HARSH ENVIRONMENTS

This invention may be manufactured and used by or for the Government for governmental purposes without the payment of any royalties thereon or therefor.

CROSS REFERENCE TO RELATED APPLICATION

This application is related to the following copending application: Ser. No. 742,152, entitled, "Dual Optical Mechanical Position Tracker" filed in the name of Seth L. Everett, Jr., the present inventor.

BACKGROUND OF THE INVENTION

1. Field of the Invention

This invention relates generally to impact type moving carriage printers and more particularly to such printers which are required to operate in a harsh environment.

2. Description of the Prior Art

Electric typewriters are known which have circuitry for automatically turning off power after a predetermined period of non-use. Examples of such apparatus include: U.S. Pat. No. 3,354,372, entitled, "Delay Responsive Shut-Off Device For Operationally Vibrating Electric Equipment", which issued to J. O. Beasley on Nov. 21, 1967; and U.S. Pat. No. 3,753,004, entitled, "Electric Typewriter Automatic On-Off Switch", which issued to Paul C. Dominic on Aug. 14, 1973. In the last mentioned patent, an embodiment is disclosed which includes an impact sensor for detecting impact on the spacer bar for turning the typewriter on. There is no provision, however, for temporarily interrupting the printing operation during a period of unusually high vibration or shock and thereafter continuing operation without illegible character printing and/or losing data upon the termination of the unusually high vibration or shock level.

Also known in the art of electric typewriters and high speed printers is the inclusion of input data storage means for acting as an input buffer for data fed into the system at a greater rate than it can be utilized by the printing mechanism. Typical examples of such apparatus are: U.S. Pat. No. 3,718,243, entitled, "Apparatus For Storing Typing Commands Given In Too Rapid Succession By Keys", issued to K. Chvatlinsky, on Feb. 27, 1973; U.S. Pat. No. 3,924,722, entitled, "Typewriter With Electronic Keyboard", issued to J. L. Wienhold, on Dec. 9, 1975; U.S. Pat. No. 3,973,662, entitled, "Acceleration Control System For High Speed Printer", issued to J. R. Fulton on Aug. 10, 1976; U.S. Pat. No. 4,203,678, entitled "Electronic Control Circuit For A High Speed Bi-directional Printer", issued to L. A. Nordstrom, et al. on May 20, 1980; and U.S. Pat. No. 4,405,245, entitled, "Variable Speed Signal Printing Apparatus", which issued to T. Fukushima on Sept. 20, 1983. While such apparatus purports to operate in the respective manners disclosed, they do not operate so as to provide a temporary storage for printing data during the occurrence of unusually high vibration and/or shock levels which have a tendency to move the print head from a known valid print position.

Accordingly, it is an object of the present invention to provide an improvement in printing apparatus.

Another object of the invention is to provide an improvement in impact dot matrix printing mechanisms.

A further object of the invention is to provide an improvement in dot matrix printers which are capable of operating in harsh environments.

SUMMARY

Briefly, the foregoing and other objects are achieved by a method and apparatus for temporarily interrupting operation of a dot matrix printer when vibration and/or shock sensing means detect a level beyond a predetermined threshold. Print data is temporarily stored in an input buffer and inhibited from being applied to the print head through a pair of print line data buffers along with cessation of the operation of a stepper motor, coupled to the print head carriage. When the vibration or shock returns to a level below the threshold, printing resumes with the data being fed out of storage to the print head through the print line data buffers so that no data is lost or illegible characters printed when the equipment is experiencing vibration and shock beyond a safe operating level. When the safe operating level is exceeded, the printer carriage position is also tracked to determine if it has moved from its last valid driven position and is thereafter repositioned before printing is resumed.

BRIEF DESCRIPTION OF THE DRAWINGS

While the present invention is defined in the claims annexed to and forming a part of this specification, a better understanding can be had by reference to the following description when taken in conjunction with the accompanying drawings in which:

DESCRIPTION OF THE PREFERRED EMBODIMENT

Figure 1:
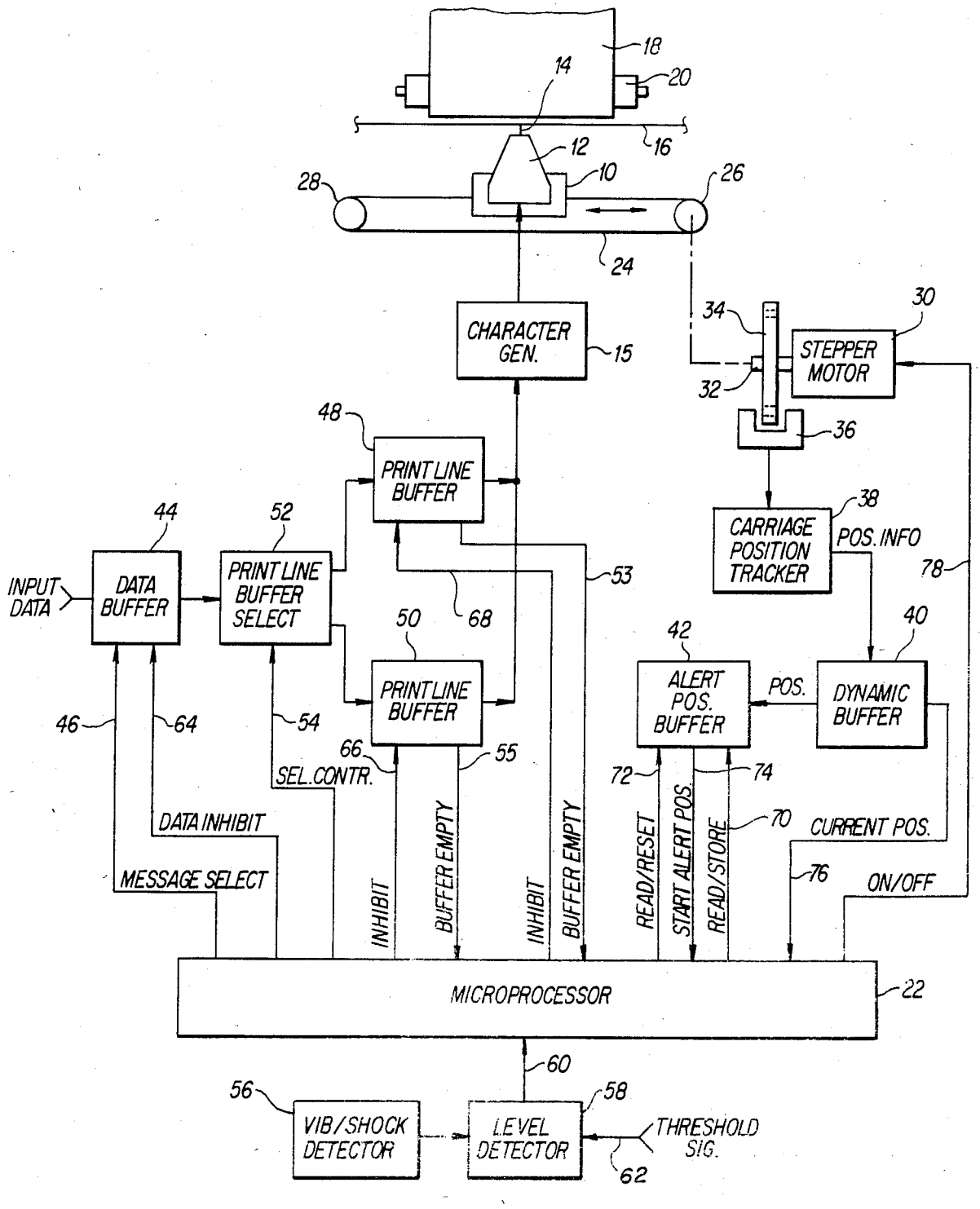
FIG. 1 is a block diagram illustrative of the preferred embodiment of the invention.

Referring now to the drawings and more particularly to FIG. 1, disclosed thereat is the block diagram which is illustrative of the inventive concept of this invention and entails a method and apparatus for operating a dot matrix printer in a harsh environment which may be encountered, for example, with tactical military equipment. Such apparatus requires printers to be operational during periods of vibration and shock without the printing of illegible characters or loss of data. As shown in FIG. 1, reference numeral 10 designates a carriage on which is mounted a dot matrix print head 12. The print head 12 includes a plurality of print wires 14 which, when activated in response to a character or symbol generation signal from a character generator 15, causes a print ribbon 16 to be forced against the face of a printing medium 18. The printing medium 18, for example, comprises a sheet of paper or the like which is moved by means of a platen or roller 20. The roller in turn is normally rotated in accordance with a rotational drive motor, not shown, in a conventional fashion. Control of the printing system as shown in FIG. 1 is implemented by means of a programmed microprocessor 22, a device well known and widely used for control applications.

The carriage 10, moreover, is translated back and forth by means of a positive no-slip belt 24 or other similar apparatus wound around a pair of pulleys 26 and 28. The pulley 26, for example, comprises the drive pulley and is mechanically coupled to and rotatably driven by a stepper motor 30 whose shaft 32 is mechanically coupled thereto. The pulley 28, on the other hand, comprises an idler pulley. Positioning and timing information concerning the rotary movement of the stepper motor shaft 32 and accordingly the print head carriage 10 is provided by an apertured timing wheel or disc 34. Regularly spaced apertures in the disc 34 transmit and interrupt light between pairs of photo emitters and receptors, not shown, contained in a photo-electric sensor assembly 36 as taught in the above referenced related application Ser. No. 742,152 entitled, "Dual Optical Mechanical Position Tracker". Further as taught in the related application, electrical signals are generated in response to rotation of the timing wheel 34 which are coupled to a carriage position tracker logic circuit 38 and which then operate to provide carriage position information in the form of binary digital output. In the present invention, the carriage position information in turn, is fed to a dynamic buffer memory 40 which supplies current position information both to the microprocessor 22 and an "alert" position buffer memory 42 for purposes which will be explained subsequently.

Print data for controlling the character generator 15 is provided by a message input memory in the form of a relatively large digital input data buffer 44 which is adapted to operate as a temporary data storage and formatting means for an input data stream. The data buffer 44 in normal operation formats print data under the control of the microprocessor 22 via a signal coupled to a message select control signal bus 46 to form strings of data which comprise data print lines which are alternately fed to a pair of data print line buffer memories 48 and 50. Alternate loading and unloading of the print line buffers 48 and 50 are furthermore controlled by a print line buffer selector 52 which is also controlled by the microprocessor 22 via the signal bus 54. As each print line buffer memory 48 and 50 unloads its contents in turn, the output thereof is fed to the character generator 15 which operates to control the print head 12 in a manner well known to those skilled in the art. When the data content of each print line buffer has been completely downloaded to the print head character generator 15, a "buffer empty" signal is sent to the microprocessor 22 via either signal bus 53 or 55 whereupon the microprocessor 22 sends a control signal via signal bus 54 to couple the "empty" print line buffer to the input data buffer 44.

The present invention additionally includes a sensor assembly comprised of a vibration/shock detector device 56 which is operable to generate an electrical output signal whose amplitude corresponds to the level of the shock or vibrational forces being applied to the printing system from a source or sources existing in the surrounding operational environment. The output of the detector 56 is coupled to a level detector circuit 58 which is operable to provide an electrical signal on circuit lead 60, for example, when the amplitude exceeds a predetermined threshold. The threshold can be selectively set by means of an input signal voltage applied via signal lead 62. The level detector circuit 58 can be of any conventional type, one example of which comprises a well known biased digital gate circuit.

As indicated above, the primary objective of the invention is to temporarily disable the printer during periods when the level of vibration/shock exceed the predetermined "safe" level for reliable printing operation while precluding the loss of print data, with the resumption of normal operation when the threshold for safe operation is no longer exceeded.

Accordingly, when the signal output of the level detector 58 exceeds the threshold signal level of the signal appearing on lead 62, the microprocessor 22 inhibits data transfer to print line buffers 48 and 50 from the input data buffer 44 by the application of a control signal on signal bus 64, whereupon all further input data will be temporarily stored in the input data buffer 44. Concurrently with this operation the microprocessor 22 applies separate control signals over signal buses 66 and 68 which operate to inhibit data transfer from the print line buffers 48 and 50 to the print head's character generator 15. This dormant state of the printer with the exception of the continual acceptance of the input data stream by the data buffer 44 continues so long as the vibration/shock level exceeds the safe threshold level. When a safe operating condition subsequently exists, inhibiting signals are removed from the data buffer 44 and the two print line buffers 48 and 50. Printing then resumes with the temporarily stored data being applied alternately to and out of the print line buffers 48 and 50.

Because there is a possibility that the carriage 10 upon which the print head 12 is mounted may be jostled or otherwise moved from its last valid print position during a disturbance exceeding the safe vibration/shock level, the microprocessor 22 is operable in conjunction with the dynamic buffer 40 and the position buffer 42 to determine any change of position or "delta" from the print head's last valid driven position and thereafter reposition the print head carriage 10 by activation of the stepper motor 30 in the proper direction. This is provided by an "alert" position buffer 42 which operates to store the present carriage position by a control signal being applied via signal bus 70 to the buffer 42 which immediately stores the position information contained in the dynamic buffer 40 at the time the threshold level is exceeded. When the level detector output signal on signal lead 60 indicates that a safe operating level exists, a read signal is applied to the buffer 42 via the signal bus 72 which causes the position of the carriage at the start of "alert" condition to be applied to the microprocessor 22 via a digital data bus 74. The digital positional information applied to the microprocessor via the data bus 74 is compared with the current carriage position information which appears on the output digital data bus 76 from the dynamic buffer 40. If there is any error value between the two positional values, the microprocessor will activate the stepper motor 30 via the on/off signal 78 to move the carriage 10 until the "delta" is reduced to zero. When carriage 10 has been successfully returned to its position at the time of the "alert", a reset signal is applied to buffer 42 and previous inhibit signals on signal bus 64, 66, and 68 are removed.

A graphical representation of the method for maintaining coherent dot matrix print operation in the presence of a harsh vibration/shock environment is shown in the time related diagrams of FIGS. 2A through 2F. A common unit of time(t) is shown in connection with FIG. 2A and is applicable to the remaining FIGS. 2B through 2F.

Figures 2A, 2B, 2C, 2D, 2E, 2F:
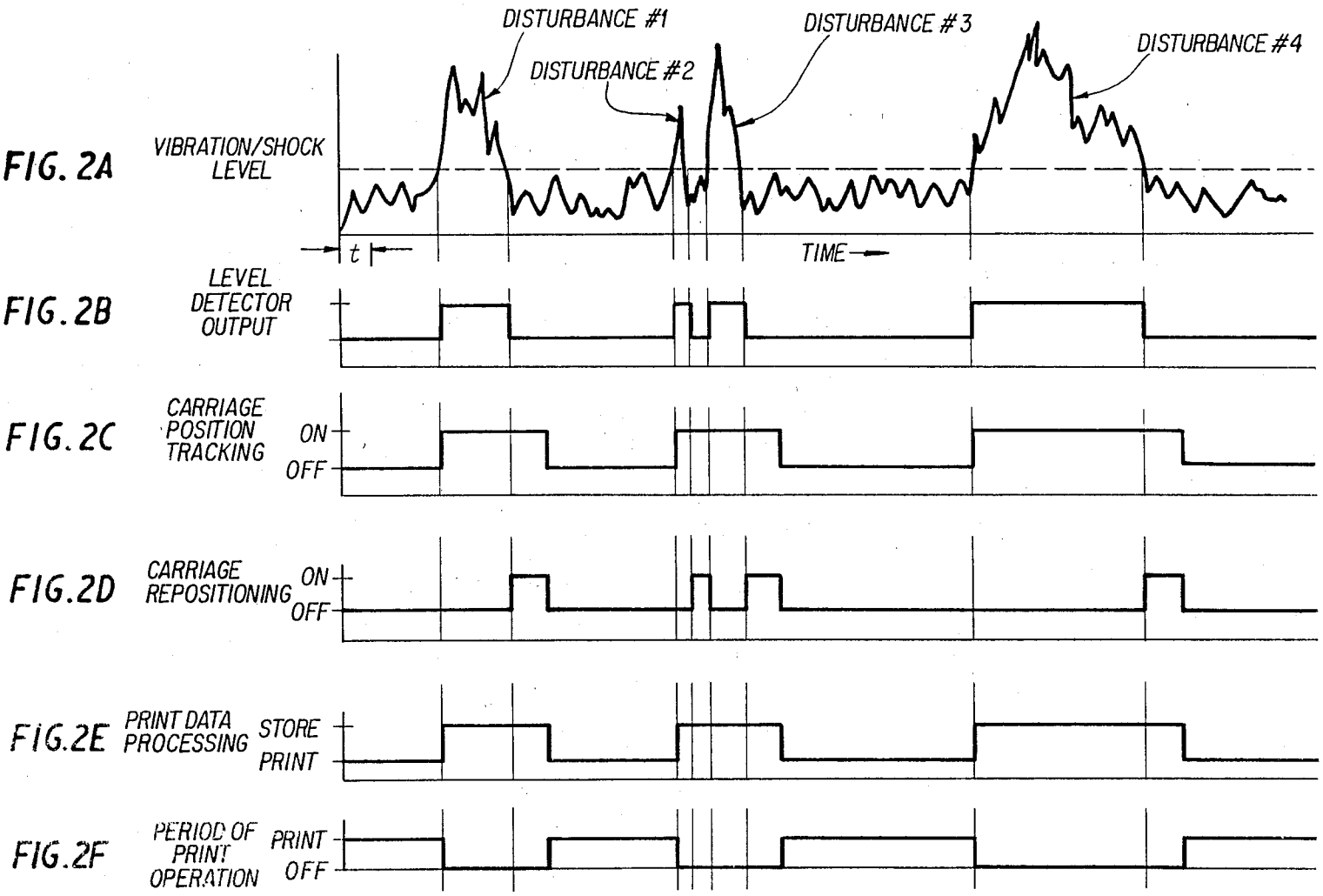
FIGS. 2A through 2F are a set of time related diagrams helpful in understanding the subject invention.

Four separate disturbances are illustrated in FIG. 2A which exceed a predetermined threshold level allowable for reliable printer operation. Disturbance #1 has a duration of 2t and is widely separated in time from the next disturbance #2. Disturbance #2 has a duration of 0.5t and is closely followed by disturbance #3, after an interval of 0.5t and has a duration of t. Disturbance #3 is widely separated from disturbance #4 which has a duration of 0.5t.

FIG. 2B is a waveform illustrative of the output of the vibration/shock sensor level detector 58 shown in FIG. 1 and consists of a binary signal indicated by the first or lower amplitude and second or higher amplitude, respectively. The detector output is in the high state during an "alert" condition indicative of a disturbance level being above the threshold level shown in FIG. 2A. Otherwise, the output is in the low state.

FIG. 2C, on the other hand, is a binary type waveform illustrative of a time when the carriage position tracking is taking place. Since it is assumed that the repositioning of the print head carriage 10 to its position, prior to the occurrence of the disturbance, will typically require a time period equal to t, tracking continues past the cessation of the threshold level (FIG. 2A) by an additional time t. This time, however, can vary as a function of how far the print head 12 and accordingly the location of the carriage 10 has been altered from its predisturbance position. Since vibration/shock disturbances tend to be bi-directional in nature, it might be expected that in its final position, the print head carriage 10 will remain fairly close to its predisturbance or "pre-alert" position. Thus the tracking time will be equal to the time that the threshold level is exceeded plus a time increment t for correct repositioning of the print head. Furthermore, it can be seen that the tracking mode is active for a duration of 3t for disturbance #1. However, for disturbances #2 and #3, these disturbances occur relatively close in time so that recovery from disturbance #2 is not completed when disturbance #3 is encountered. Therefore, a total duration of 3t is necessitated.

FIG. 2D is a waveform illustrative of the time in which the print head carriage repositioning occurs following the disturbance level falling below the threshold level shown in FIG. 2A. With respect to disturbance #1, the print head carriage 10 is correctly repositioned in time duration t; however, for disturbance #2, the attempt to correct or reposition the carriage 10 during a time duration of 0.5t is interrupted by a second vibration/shock, i.e., disturbance #3. In this instance, the action of repositioning is immediately terminated as the system returns to position tracker operation as shown in FIG. 2C. The alert position buffer 42, however, is not reset until carriage 10 repositioning is complete as noted earlier.

With respect to FIG. 2E, there is shown a binary waveform which is indicative of a "print" state and a "store" state and thus is indicative of the time duration when data to be printed is either temporarily stored while the print head carriage 10 is being disturbed and/or recovering from a disturbance and those times when data is released to the character generator 15 of the print head 12 for normal printing. As shown, with respect to disturbance #1, data is caused to be stored in the data buffer 44 for a duration of 3t which also includes a time for repositioning the carriage 10. For disturbances #2 and #3, data is continuously stored for a time duration of 3t. This is followed by the normal printing period of 6t until disturbance #4 occurs, causing data to be stored for a duration of 6t.

FIG. 2F, accordingly, is indicative of the time periods of normal printing operation as shown by the "print" state.

The method and apparatus disclosed herein will permit dot matrix moving print head carriage type printers to operate under what has been previously considered impossible vibration/shock level conditions. Since conventional communication terminal printers are presently microprocessor based systems and employ extensive on-board electronic memory for data buffer storage, the print data storage portion can easily be implemented within the storage capability of the microprocessor as shown in the preferred embodiment. Thus only the vibration/shock detector 56 and the level detector 58 must be added.

The sequential technique disclosed for processing the events described with respect to FIGS. 2A through 2F require the temporary print data storage; however, the carriage position tracker portion of the system shown in FIG. 1, while being desirable, is not necessarily essential. The latter feature, however, insures a printer fully capable of operation in harsh environments where only occasional high intensity vibration/shocks of short duration are incurred and which are most likely of the type that an operator would not even be aware of the fact that corrective activity is occurring. As the disturbance repetition rate increases, however, or becomes of longer duration, the operator will notice occasional printing stoppages but with reasonable memory storage capacity of the data buffer 44, no illegible characters will be printed and no data will be lost.

Having thus shown and described what is at present considered to be the preferred embodiment, it should be noted that the same has been made by way of illustration and not limitation. Accordingly, all alterations, modifications and changes coming within the spirit and scope of the invention as set forth in the appended claims are herein meant to be included.

I claim:

1. A method of controlling the operation of printing apparatus subjected to relatively high levels of vibration and shock, comprising the steps of:

sensing said shock and/or vibration;

terminating printing operation when the level of said shock and/or vibration exceeds a predetermined threshold level;

temporarily storing any further input data utilized for printing indicia on a printing medium during a period when said predetermined threshold level is exceeded; and thereafter releasing said input data temporarily stored and resuming normal printing operation when the level of said shock and/or vibration falls below said threshold, whereby substantially no data is lost or illegible characters are printed when the apparatus is experiencing vibration and/or shock beyond a safe operating level.

2. The method as defined by claim 1 wherein said printing apparatus comprises an impact type printer including a movable carriage and a print head mounted thereon, and wherein said step of terminating said printing operation comprises stopping controlled movement of said carriage as well as inhibiting the coupling of print data to said print head.

3. The method as defined by claim 2 wherein said carriage is driven in accordance with electrical pulses applied to a stepper motor coupled to said carriage, and wherein said step of stopping controlled movement of said carriage comprises stopping the application of pulses to the stepper motor.

4. The method as defined by claim 2 wherein said printing operation further includes the steps of entering said input data into an input buffer memory, transferring print data therefrom alternately into a pair of print line buffer memories, and feeding print data in the form of print lines out of said pair of buffer memories alternately to character generator means coupled to said print head.

5. The method as defined by claim 4 wherein said step of inhibiting application of data to said character generator means includes the further step of inhibiting the transferring of print data to said pair of print line buffer memories, and inhibiting the feeding of each said print line out of said print line buffer memories.

6. The method as defined by claim 2 wherein said step of sensing further includes the steps of detecting the amplitude of shock and/or vibration forces acting on said printing apparatus and generating an operation terminating signal when said amplitude exceeds a known threshold amplitude beyond which reliable operation cannot be obtained.

7. The method of claim 2 and additionally including the step of tracking the movement of said carriage from a last valid driven position during said period when said predetermined threshold is exceeded, and repositioning said carriage to said last valid driven position prior to resuming normal printing operation.

8. The method as defined by claim 7 and wherein said printing operation further includes the steps of coupling said input data into an input buffer memory, transferring the print data portion of said input data alternately to a first and second data print line buffer memory, and alternately feeding said print data to character generator means coupled to said print head from said first and second buffer memory.

9. The method of claim 8 wherein said inhibiting step further includes inhibiting transferring said print data to said first and second buffer memory and inhibiting feeding said print data to said print head from said first and second buffer memory.

10. The method of claim 7 wherein said tracking step comprises storing the carriage position value in a memory at the time when said threshold is exceeded, reading said stored carriage position value out of said memory when said threshold is no longer exceeded, comparing the stored carriage position value with the carriage position value when said threshold is no longer exceeded, and thereafter determining any position error value, and wherein said repositioning step includes activating a carriage drive motor in response to said position error value.

11. The method of claim 7 wherein the period of tracking the movement of said carriage extends a predetermined increment of time beyond said period when said predetermined threshold is exceeded.

12. Apparatus for controlling an impact type printer subjected to relatively high levels of vibration and shock, comprising:

means for sensing said shock and/or vibration and generating a control signal when the level of said shock and vibration exceeds a predetermined magnitude;

control means for controlling the operation of said printer and being responsive to said control signal for interrupting a printing operation as long as said predetermined magnitude is exceeded;

data memory means controlled by said control means for temporarily storing input data used for the printing of indicia on a printing medium during a period when said predetermined magnitude is exceeded;

said control means being further operable to cause said data memory means to release said data temporarily stored and to reinitiate said printing operation when the level of said shock and/or vibration falls below said predetermined magnitude, whereby substantially no data is lost or illegible characters are printed when the apparatus is experiencing vibration and/or shock beyond a safe operating level.

13. The apparatus as defined by claim 12 wherein said impact type printer further includes a movable carriage and a print head mounted thereon.

14. The apparatus as defined by claim 13 wherein said carriage is driven in accordance with electrical pulses applied to a stepper motor coupled to said carriage, said control means being further operable to generate said pulses.

15. The apparatus as defined by claim 13 wherein said data memory means further comprises an input buffer memory for input data, and a pair of print line buffer memories alternately coupled to said input buffer memory under control of said control means for receiving print data therefrom and coupling print data in the form of print lines alternately to a character generator coupled to said print head.

16. The apparatus as defined by claim 15 wherein said control means operates to inhibit print data from being coupled to said pair of print line buffer memories when said predetermined magnitude is exceeded.

17. The apparatus as defined by claim 15 wherein said control means operates to inhibit print data from being coupled to said print head from said pair of print line buffer memories when said predetermined magnitude is exceeded.

18. The apparatus as defined by claim 15 wherein said control means operates to inhibit print data from being coupled to said pair of print line buffer memories and to inhibit said dot print lines from being alternately coupled to said print head when said predetermined magnitude is exceeded.

19. The apparatus as defined by claim 15 wherein said pair of print line buffer memories are operable to generate a respective signal when their data content is empty, and wherein said control means is responsive to said signals for alternately coupling said input buffer memory to said pair of print line buffer memories.

20. The apparatus as defined by claim 13 and additionally including means for tracking the movement of said carriage from a last valid driven position during said period when said predetermined threshold is exceeded, said means for tracking being further operable to supply information to said control means for repositioning said carriage to said last valid driven position prior to resuming normal printing operation.

21. The apparatus as defined by claim 20 wherein said means for tracking the movement of said carriage includes circuit means for generating a carriage position signal, first memory means for storing the carriage position signal of the current position, second memory means controlled by said control means for storing the carriage position signal at a time said threshold is exceeded, and comparator means coupled to said first and second memory means for comparing the stored carriage position signal at the time said threshold is exceeded and the current carriage position signal when said threshold is no longer exceeded and generating a position error signal, said control means being operable in response to said position error signal for repositioning said carriage to said last valid driven position prior to resuming normal printing operation.

22. The apparatus as defined by claim 19 wherein said control means comprises a microprocessor.

* * * * *